US008357234B2

(12) United States Patent
Sluder et al.

(10) Patent No.: US 8,357,234 B2
(45) Date of Patent: Jan. 22, 2013

(54) APPARATUS AND METHOD FOR RAPID SEPARATION AND DETECTION OF HYDROCARBON FRACTIONS IN A FLUID STREAM

(75) Inventors: Charles S. Sluder, Knoxville, TN (US); John M. Storey, Oak Ridge, TN (US); Samuel A. Lewis, Sr., Andersonville, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 355 days.

(21) Appl. No.: 12/840,341

(22) Filed: Jul. 21, 2010

(65) Prior Publication Data

US 2012/0017760 A1 Jan. 26, 2012

(51) Int. Cl.
*B01D 53/02* (2006.01)

(52) U.S. Cl. ..... 96/101; 96/102; 96/104; 96/106; 96/108; 96/121; 73/23.42

(58) Field of Classification Search ..... 96/101, 96/102, 104, 106, 108, 112, 121; 73/23.42, 73/23.35; 95/82, 87
See application file for complete search history.

(56) References Cited

U.S. PATENT DOCUMENTS

| | | | | |
|---|---|---|---|---|
| 5,759,236 | A * | 6/1998 | Bruck et al. | 95/41 |
| 7,434,449 | B2 | 10/2008 | Kusaka et al. | |
| 2006/0144124 | A1 | 7/2006 | Kusaka et al. | |
| 2009/0003125 | A1 | 1/2009 | Kusaka et al. | |

* cited by examiner

*Primary Examiner* — Robert Clemente
(74) *Attorney, Agent, or Firm* — Colin L. Cini

(57) ABSTRACT

An apparatus and method for rapid fractionation of hydrocarbon phases in a sample fluid stream are disclosed. Examples of the disclosed apparatus and method include an assembly of elements in fluid communication with one another including one or more valves and at least one sorbent chamber for removing certain classifications of hydrocarbons and detecting the remaining fractions using a detector. The respective ratios of hydrocarbons are determined by comparison with a non separated fluid stream.

9 Claims, 5 Drawing Sheets

APPARATUS AND METHOD FOR RAPID SEPARATION AND DETECTION OF HYDROCARBON FRACTIONS IN A FLUID STREAM

STATEMENT AS TO INVENTION RIGHTS UNDER FEDERALLY SPONSORED RESEARCH

This disclosure arose in the performance of Prime Contract No. DE-AC05-00OR22725 between UT-Battelle, LLC and the U.S. Department of Energy. The government has certain rights in the invention described herein.

FIELD

This disclosure relates to the field of fluid stream analysis. More particularly, this disclosure relates to an apparatus and method for rapid separation and detection of hydrocarbon fractions in a liquid or gas.

BACKGROUND

There is a need for a real-time, in-situ determination of the relative ratios between volatile (VOC) and semi-volatile (SVOC) hydrocarbons in sample fluid streams.

For example, increasingly stringent emissions regulations for diesel engines are resulting in tighter engineering targets for engine components. Exhaust gas recirculation (EGR) is a means for reducing $NO_X$ production by re-circulating a portion of exhaust gases from an engine back into the combustion chambers of the engine to reduce combustion temperatures. Such EGR streams are frequently cooled by use of a gas-to-water heat exchanger to enhance the cooling effect of the EGR gases on the overall combustion process. Historically, EGR coolers have not required high heat exchanger effectiveness. This is changing, however, because the low target temperatures for engine exit gases are being driven down even lower because of more stringent $NO_X$ emissions standards. This downward shift has resulted in similarly and related stringent requirements regarding heat exchanger effectiveness and issues with fouling of EGR coolers caused by particulate matter (PM) and (SVOC) deposition within gas flow paths.

Calibration to meet modern efficiency and emissions targets for diesel and other engines involves complex optimization of a large number of control parameters. Rapid assessments of PM emissions are already possible by, for example, the use of a tapered-element oscillating microbalance or an optical smoke meter. Relatively rapid total hydrocarbon measurements are possible by using a heated flame ionization detector (HFID). However, HFID measures all of the hydrocarbons present when in fact only a fraction of the overall hydrocarbons are culprits with regard to the fouling of EGR coolers. Historically, obtaining more information than is available with an HFID typically required speciation of the hydrocarbons using gas chromatography (GC). GC analysis provides much more information about the hydrocarbons than an HFID, but GC cannot be accomplished rapidly enough to support activities such as, for example, real-time engine calibration.

What is needed, therefore, is an apparatus and method for rapidly determining the relative ratios between VOCs and SVOCs in a sample fluid stream such as an exhaust gas mixture. More specifically, what is needed is an apparatus and method for rapidly determining the relative ratios between VOCs and SVOCs in the exhaust gas mixture of modern compression ignition and spark ignition engines.

BRIEF DESCRIPTION OF THE DRAWINGS

Features, aspects, and advantages of the present disclosure will become better understood with reference to the accompanying figures, detailed description, and appended claims. The elements shown in the various figures are not to scale so as to more clearly show the details and like reference numbers indicate like elements throughout the several views.

DETAILED DESCRIPTION

Figure 1:
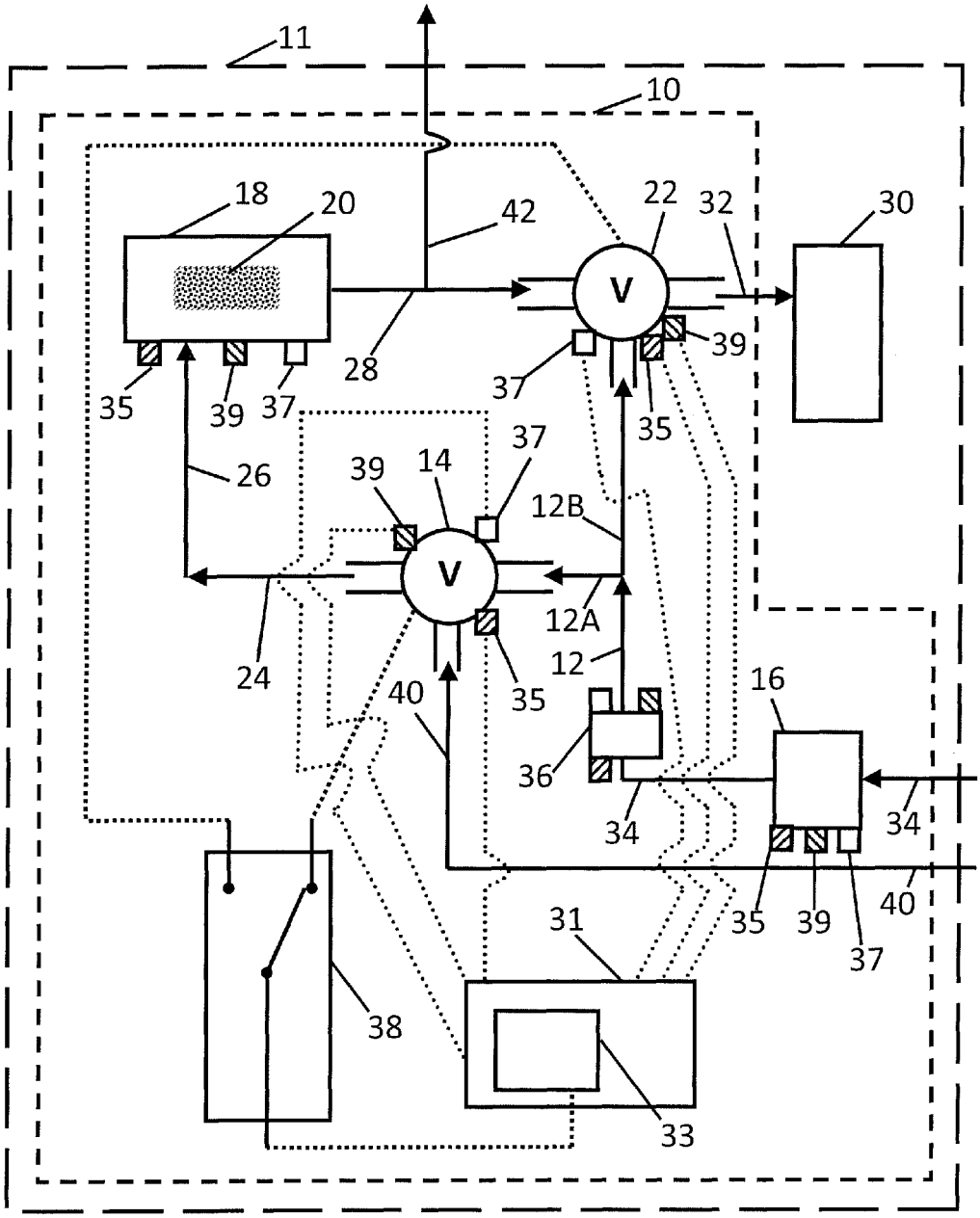
FIG. 1 is a schematic view of a separation and a detection apparatus according to a first example.

Various terms used herein are intended to have particular meanings Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

assembly (noun): a plurality of components attached together to form a compound component.

fluid communication: a relationship between two or more objects attached adjacent one another whereby fluid flowing within or along a first object is free to flow through or along a second object assuming a sufficient impetus is present to cause such flow from the first object to the second object or vice versa.

parallel fluid communication: a relationship between two or more objects (e.g., a first object and a second object) attached adjacent one another by a plurality of parallel conduit assemblies whereby fluid flowing within or along the first object is free to flow to the second object via any of the parallel conduit assemblies there between assuming a sufficient impetus is present to cause such flow from the first object to the second object or vice versa.

sorbent: any material capable of taking up and holding a substance via absorption, adsorption, or any other means of physical or chemical attraction and/or adhesion.

valve: (1) a mechanical apparatus configured for directing, starting, and/or stopping the flow of liquid, gas, or small solids using one or more movable parts to open, close, or partially obstruct one or more flow channels; (2) an assembly of one or more valves (definition part 1) and associated connecting structures to direct, start, and/or stop one or more streams of liquid, gas, or small solids.

Various examples described herein are intended for rapidly separating and detecting the relative concentrations of different classes or phases of hydrocarbons in a sample fluid stream. Typically, fluid streams such as diesel exhaust, for example, include several classifications of hydrocarbons such as semi-volatile organic compounds (SVOCs), and volatile organic compounds (VOCs). The SVOCs can contribute to undesirable deposit buildup in various applications in which hydrocarbon fluids are present. A goal of the examples described herein is to rapidly gain an overall concentration reading of total hydrocarbons in a sample fluid stream, gain a second concentration reading of the volatile organic compounds in the stream by first removing the semi-volatile organic compounds prior to acquiring a second hydrocarbon measurement, wherein the concentration of semi-volatile organic compounds is deduced from the concentration of the overall stream minus the volatile organic compound concentration obtained in the second hydrocarbon measurement. In some examples, the SVOCs are removed in successive steps such that a portion of the SVOC's are removed in each step.

FIG. 1 shows a first example of a first fluid separator 10 and first fluid stream analyzer 11 having a first inlet conduit assembly 12 including a first inlet first branch conduit assembly 12A and a first inlet second branch conduit assembly 12B; a first valve 14 attached in fluid communication with the first inlet first branch conduit 12A; a sorbent chamber 18 including a sorbent 20; and a second valve 22 attached in fluid communication with the first sorbent chamber 18. The second valve 22 is also attached in parallel fluid communication with the first inlet second branch conduit assembly 12B. The first valve 14 is attached to the sorbent chamber 18 by a first conduit assembly 24 and a second conduit assembly 26, and the sorbent chamber 18 is attached to the second valve 22 by a third conduit assembly 28. In the example shown in FIG. 1, the second valve 22 may extend in fluid communication to a detector 30 by a fourth conduit assembly 32.

The first fluid separator 10 is configured for attachment to the detector 30. For example the detector 30 can be a heated flame ionization detector (HFID), an infrared-type detector (IR), a mass spectrometer or other type of detector that may be disposed downstream of, attached to, or retrofitted with, the first fluid separator 10 to comprise the first fluid stream analyzer 11.

In the case of, for example, an internal combustion engine, the raw exhaust is preferably sampled, to obtain a baseline measure of the total hydrocarbon content. The sample stream, passing through a fifth conduit assembly 34 in FIG. 1, is first passed through a pre-filter 16 to remove particulate matter PM and may additionally be diluted by a dilution device 36 prior to analysis by the detector 30. Other examples of the first fluid separator 10 and first fluid stream analyzer 11 do not include a dilution device 36.

During operation, the various valves shown in FIG. 1 may assume a first configuration, which allows the sample fluid to pass through the pre-filter 16 to the first valve 14. Although other examples contemplated herein do not require a pre-filter 16, such pre-filtration is desirable because it prevents particulate matter from contaminating the first valve 14 and the first sorbent chamber 18. While in the first configuration, the second valve 22 allows filtered fluid from the first sorbent chamber 18 to pass through the second valve 22 on to the detector 30 for detection while substantially preventing unfiltered sample fluid from the first inlet second branch conduit assembly 12B from passing through the second valve 22. The valves may, alternatively, assume a second configuration during which the first valve 14 prevents sample fluid from passing directly through the first valve 14. While in the second configuration, the second valve 22 allows unfiltered sample fluid to pass from the first inlet second branch conduit assembly 12B through the second valve 22 on to the detector 30 for detection while substantially preventing filtered fluid from passing from the first sorbent chamber 18 through the second valve 22. The various valve positions are preferably actuated by a selector switch 38 (or switches) which is/are controlled by an intelligence system 31 for example. The intelligence system 31 includes a controller 33 for controlling various aspects of the first fluid separator 10 as needed including, for example, actuation signals to change valve configuration, cooling activation, fluid propulsion (e.g., pump) activation and/or deactivation, and other similar functions. More specifically, the intelligence system 31 along with the controller 33 may be used to activate or deactivate heating devices 35 and/or cooling devices 37 based on feedback from temperature sensors 39.

The sorbent 20 material is chosen to selectively remove constituents of the sample fluid stream, such as SVOC or VOC phases of hydrocarbons for example, based on one or more physical properties such as vapor pressure. Sorbent media made of substantially inert materials may be used to inhibit chemical reactions in the sample stream. In the present example, the sorbent 20 is preferably made wholly or partially from an inert sorbent material selected from the group consisting of polymer, glass, carbon, graphite, and ceramic, for example. Media forms having a large surface area, such as beads and foam perform the best. In one example, glass beads of size (212-300 μm) (50-70 U.S. sieve) of the type available from Sigma-Aldrich Company of St. Louis, Mo. may be used. Temperature control throughout the separation apparatus 98 is vital to ensure proper separation between semi-volatile organic compounds (SVOCs), and volatile organic compounds (VOCs). Typically, the higher the temperature, the more likely hydrocarbon species will pass through a sorbent.

Temperature control throughout the first fluid separator 10 is vital to ensure proper separation between phases of SVOCs and VOCs. Typically, the higher the temperature, the more likely various hydrocarbon species will pass through a sorbent. Therefore, the sorbent chamber 18 is preferably maintained during operation at a lower temperature than the surrounding parts of the first fluid separator 10. For example, if the temperature of the sorbent chamber 18 is held at or near 40° C., certain diesel-range hydrocarbons (e.g., eicosane) would not pass through because such hydrocarbons have little or no vapor pressure at or near 40° C. Such species would be captured by the sorbent 20. More volatile hydrocarbons (e.g., decane), on the other hand, would pass through the first sorbent 20 and move downstream to be analyzed by the detector 30. When the remaining hydrocarbons are analyzed by the detector 30, the detection represents a specific concentration ($C_S$)—a fraction of the overall hydrocarbons in the sample fluid that are not susceptible to deposition at the temperature maintained in the first sorbent chamber 18.

In order for the specific concentration ($C_S$) to have significance, it is important to know the total concentration ($C_T$) of hydrocarbons in the sample fluid prior to capture by the sorbent material. To this end, the second configuration for the first valve 14 and the second valve 22 allows for the sample fluid to pass directly through the second valve 22, with no sorbent capture, to be detected by the detector 30. Thus, a total concentration $C_T$ of hydrocarbons in the sample fluid may be obtained to give the specific concentration $C_S$ meaning when compared to the total concentration $C_T$ of hydrocarbons in the sample fluid.

The ratio of hydrocarbons likely to form deposits at or near the temperature maintained in the sorbent chamber 18 may be calculated as $(C_T-C_S)/C_T$. The temperature maintained in the first sorbent chamber 18 may vary and be customized by the operator depending on the particular application and/or type of material being detected. The type of sorbent material chosen to form all or part of the first sorbent 20 may similarly vary and/or be customized as needed. Sorbents and operational temperatures for fluids discharged from industrial, laboratory or other applications may be chosen to achieve proper separation.

In order to avoid deposition of hydrocarbons on internal parts of the first fluid separator 10 and the first fluid stream analyzer 11, the pre-filter 16, the first valve 14, the second valve 22, and the various conduits are preferably heated to about 190° C. or greater for situations in which diesel exhaust is the primary fluid being sampled. Heat energy may be supplied by one or more heating elements within the first fluid separator 10 or may be present based on ambient heat (e.g., heat given off from a nearby engine or exhaust manifold). Depending on the particular application, cooling of the first sorbent chamber 18 may be more necessary than heating. In various examples, the intelligence system 31 is responsible for receiving sensor signals relating to, for example, the temperature of various parts of the first fluid separator 10 so as to actuate heating and/or cooling of certain portions as needed to maintain the desired temperatures in specific locations throughout the first fluid separator 10. In certain examples, heating and or cooling is accomplished by, for example, electrical resistance heating, cooling with fans, semiconductor coolers and heaters (e.g., Peltier heaters and coolers), water cooling and heating systems, or other devices.

The first fluid separator 10 preferably further includes a first purge gas conduit assembly 40 attached in fluid communication with the first valve 14 and a first excess flow conduit assembly 42 attached in fluid communication with the third conduit 28. Preferably, while the valves are in the first configuration, the first valve 14 periodically allows purge gas (e.g., nitrogen or purified air) to pass through the first valve 14 and on through the pre-filter, the first sorbent chamber 18, and out the first excess flow conduit assembly 42. The additional feature of purge capability allows the first sorbent 20 to be regenerated to extend the life of the first sorbent 20.

Although multiple valves are described with respect to the example shown in FIG. 1, this disclosure is not meant to limit the manner in which sample fluid is directed to flow throughout the separation and detection apparatuses described herein. Thus, as few as a single valve may be sufficient for a particular example depending on the complexity of the valve used.

Figure 2:
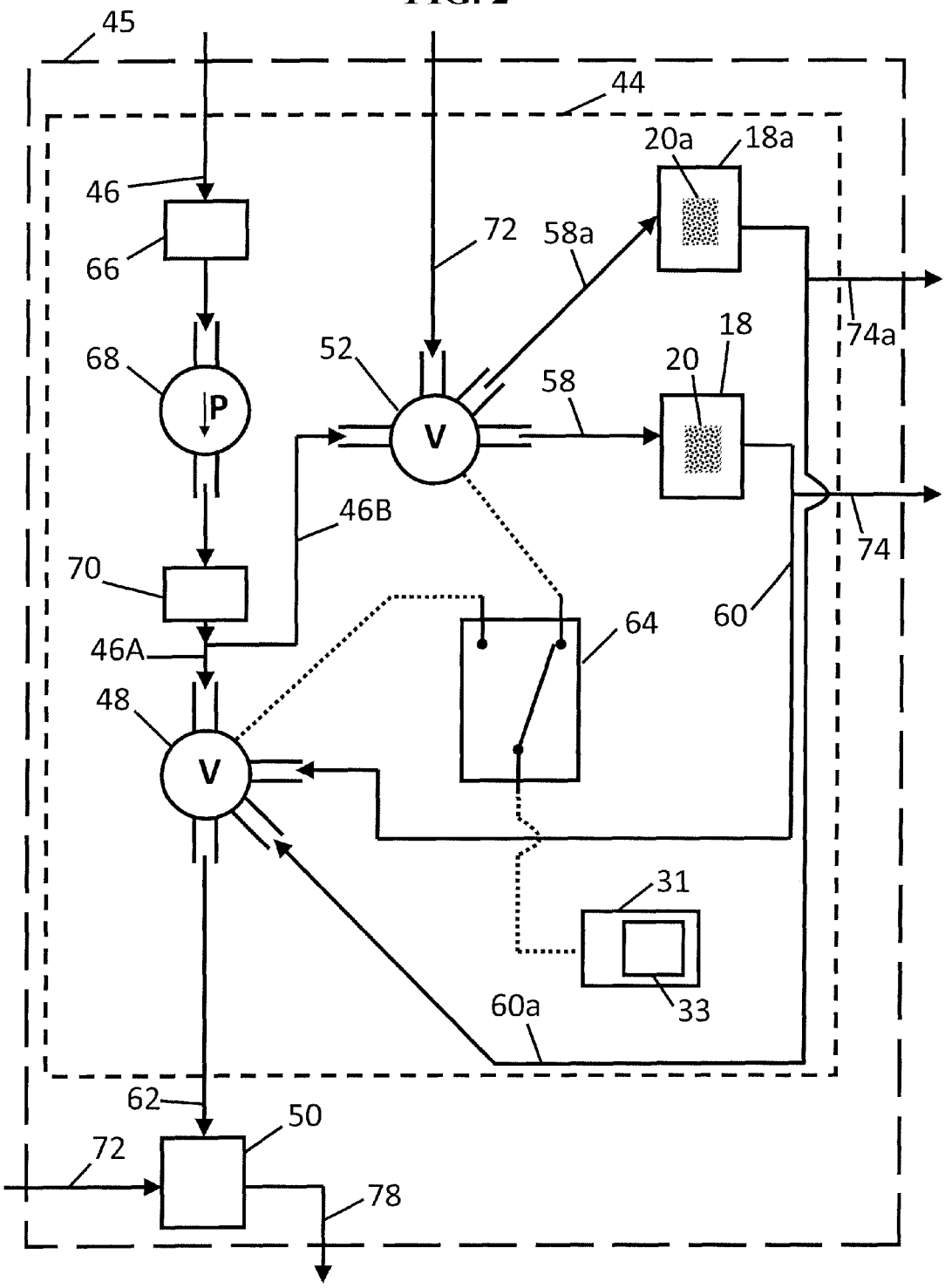
FIG. 2 is a schematic view of another example of a separation and a detection apparatus.

FIG. 2 shows an example of a second fluid separator 44 and second fluid stream analyzer 45 having a second inlet conduit assembly 46 including a second inlet first branch conduit assembly 46A and a second inlet second branch conduit assembly 46B; a third valve 48 attached in fluid communication with the second inlet first branch conduit assembly 46A; and a detector 50 attached in fluid communication with the third valve 48. The second fluid separator 44 further includes a fourth valve 52 in parallel with the third valve 48, the fourth valve 52 is attached in fluid communication with the second inlet second branch conduit assembly 46B; the first sorbent chamber 18 including the first sorbent 20, the first sorbent chamber 18 attached in fluid communication with the fourth valve 52, and the first sorbent chamber 18 is further attached upstream in fluid communication from the third valve 48. The fourth valve 52 is attached to the first sorbent chamber 18 by a sixth conduit assembly 58, the first sorbent chamber 18 is attached to the third valve 48 by a seventh conduit assembly 60, and the third valve 48 is attached to the detector 50 by an eighth conduit assembly 62.

The second fluid separator 44 is configured for attachment to the detector 50. For example the detector 50 can be a heated flame ionization detector (HFID), an infrared-type detector (IR), a mass spectrometer or other type of detector that may be disposed downstream of, attached to, or retrofitted with, the second fluid separator 44 to comprise the second fluid stream analyzer 45.

During operation, the various valves shown in FIG. 2 may assume a first configuration in which sample fluid passes through pre-filter 66 to the third valve 48 and on to the detector 50 for detection. While in the first configuration, the fourth valve prevents fluid from passing through the fourth valve 52 to the first sorbent chamber 18.

The valves shown in FIG. 2 may also assume a second configuration in which the third valve 48 substantially prevents sample fluid from passing through the third valve 48 directly to the detector 50, forcing the sample fluid toward and through the fourth valve 52, through the first sorbent chamber 18 and the first sorbent 20, and back to toward the third valve 48. The third valve 48 does allow filtered fluid from the sorbent chamber 18 to pass through the third valve 48 on to the second detector 50 for detection. The various valve positions are preferably actuated by a selector switch 64 (or switches) which is/are controlled by the intelligence system 31 and controller 33. To clarify the drawing, the control circuitry associated with intelligence system 31 has not been individually shown. In FIGS. 2-5, the schematic for the intelligence system 31 represents all the control lines, signal lines, actuators, relays, switches, temperature sensors and like hardware and software associated with the system 31 and as illustrated in FIG. 1.

In addition to the pre-filter 66, the second inlet conduit assembly 46 preferably includes a propelling apparatus (e.g., a pump 68) and a pressure controller 70 for pushing fluid through portions of the separation apparatus 44. Although the pump 68 is shown as a part of the second inlet conduit assembly 46, in an alternative example, a propelling apparatus is located along the eighth conduit assembly 62 to pull fluid through portions of the first fluid separator 44 instead of pushing fluid through.

Various parts of the second fluid separator 44 are heated and/or cooled as described above with regard to the first fluid separator 10 shown in FIG. 1.

The second fluid separator 44 preferably further includes a second purge gas conduit assembly 72 attached in fluid communication with the fourth valve 52 and a second excess flow conduit assembly 74 attached in fluid communication with the seventh conduit assembly 60. Preferably, the fourth valve 52, when in the second configuration, periodically allows purge gas (e.g., nitrogen or purified air) to pass through the fourth valve 52 and on through the first sorbent chamber 18, and out the second excess flow conduit assembly 74.

When the fourth valve 52 is in the second configuration, the fluid sample may alternatively be directed through a first parallel sorbent chamber 18*a*, thus allowing continuous operation of the second fluid separator 44 while the first sorbent 20 is being purged. In this configuration, the fourth valve 52 allows sample fluid to pass through parallel, sixth conduit assembly 58*a* to the parallel sorbent 20*a*, and then back to the third valve 48 by a parallel, seventh conduit assembly 60*a*. Alternately, the fourth valve 52 may direct sample fluid to the sorbent chamber 18 while purge gas (e.g., nitrogen or purified air) passes through the parallel sorbent chamber 18*a*, and out the parallel, excess flow conduit assembly 74*a*.

The first sorbent 20 and first parallel sorbent 20*a* are chosen to selectively remove constituents of the sample fluid stream, such as SVOC and VOC phases of hydrocarbons for example, based on one or more physical properties such as vapor pressure. Sorbent media made of substantially inert materials may be used as the sorbent 20 and parallel sorbent 20*a* to inhibit chemical reactions in the sample stream. The sorbent 20 and parallel sorbent 20*a* are preferably made wholly or partially from an inert sorbent material selected from the group consisting of polymer, glass, carbon, graphite, and ceramic, for example. Media forms having a large surface area, such as beads and foam perform the best. In one example, glass beads of size (212-300 μm) (50-70 U.S. sieve) of the type available from Sigma-Aldrich Company of St. Louis, Mo. may be used. Temperature control throughout the separation apparatus 98 is vital to ensure proper separation between semi-volatile organic compounds (SVOCs), and volatile organic compounds (VOCs). Typically, the higher the temperature, the more likely various hydrocarbon species will pass through a sorbent.

The second purge gas conduit assembly 72 is shown in fluid communication with the second detector 50. A first detector exhaust conduit assembly 78 directs exhaust from the second detector 50 out of the second fluid stream analyzer 45.

Figure 3:
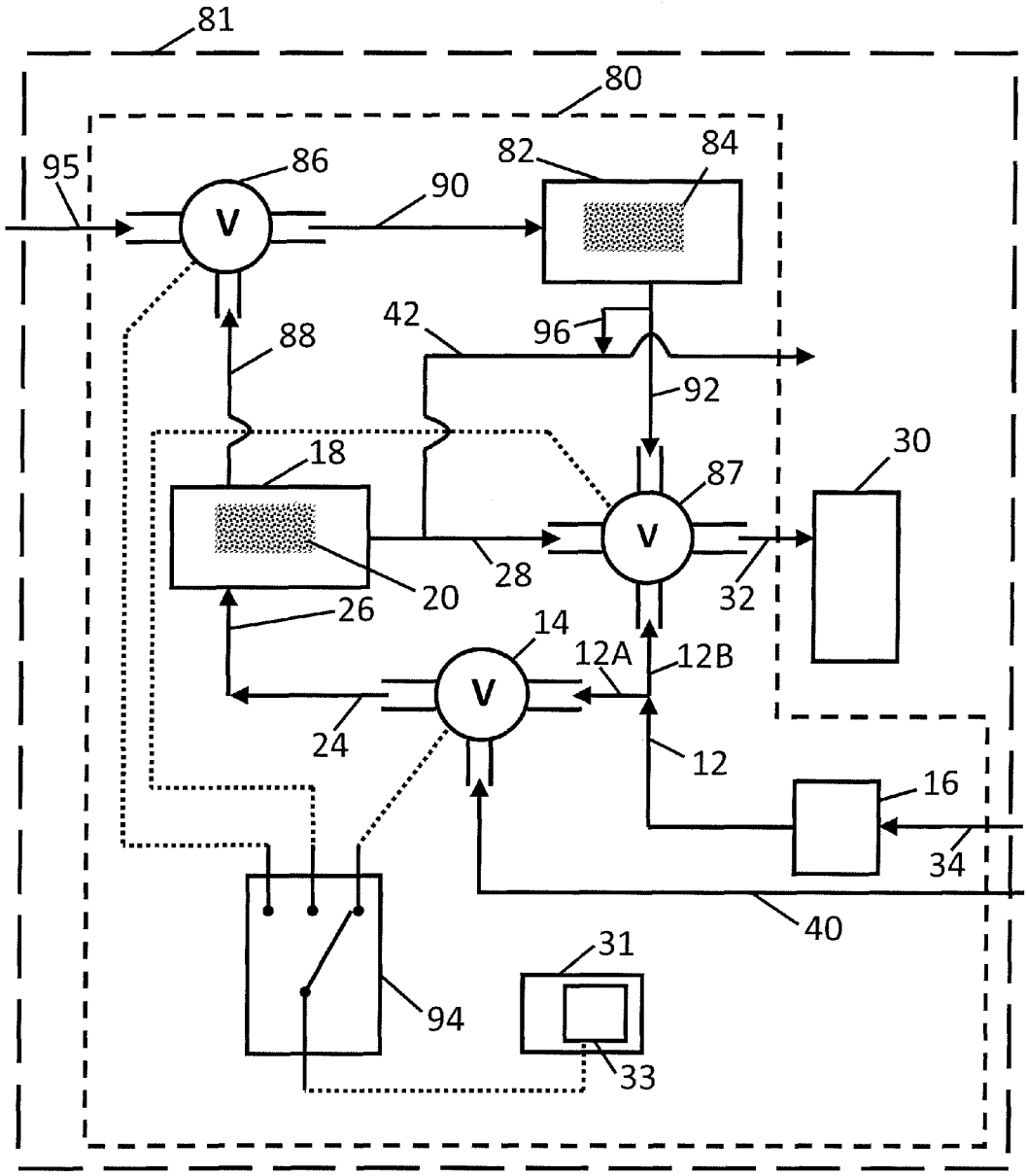
FIG. 3 is a schematic view of yet another example of a separation and a detection apparatus.

FIG. 3 shows an example of a third fluid stream separator 80 and a third fluid stream analyzer 81, which are of a similar configuration to those shown in FIG. 1 and as described above. The third fluid stream separator 80; however, includes a second sorbent chamber 82 including a second sorbent 84, a fifth valve 86, and a sixth valve 87, which is a modified version similar to the second valve 22 shown with respect to FIG. 1. The fifth valve 86 is attached in fluid communication with the first sorbent chamber 18 along a ninth conduit assembly 88. The second sorbent chamber 82 is attached in fluid communication with the fifth valve 86 along a tenth conduit assembly 90. The sixth valve 87 is attached in fluid communication with the second sorbent chamber 82 along an eleventh conduit assembly 92.

During operation, the sample fluid stream is first directed through a fifth conduit assembly 34 to a pre-filter 16. The valves shown in FIG. 3 may assume a first configuration such that fluid is allowed to flow serially through the first valve 14, through the first sorbent chamber 18, through the fifth valve 86, through the second sorbent chamber 82, through the sixth valve 87, and to the detector 30. While the valves are in a first configuration, fluid from the first sorbent chamber 18 or the first inlet conduit 12 is substantially prevented from passing through the sixth valve 87. The valves may further assume a second configuration wherein fluid is allowed to flow serially through the first valve 14, through the first sorbent chamber 18, through the sixth valve 87, and to the detector 30 without traveling through the second sorbent chamber 82. Additionally, the valves may assume a third configuration wherein fluid is allowed to flow through the sixth valve 87 and directly to the detector 30 without traveling through either the first sorbent chamber 18 or the second sorbent chamber 82. The first valve 14, the fifth valve 86, and the sixth valve 87 are preferably coordinated by a selector switch 94 and the associated intelligence system to be in specific positions to assume specific configurations.

The third fluid separator 80 is configured for attachment to the detector 30. For example the detector 30 can be a heated flame ionization detector (HFID), an infrared-type detector (IR), a mass spectrometer or other type of detector that may be disposed downstream of, attached to, or retrofitted with, the third fluid separator 80 to comprise the third fluid stream analyzer 81.

The third fluid stream separator 80 preferably further includes a first purge gas conduit assembly 40 attached in fluid communication with the first valve 14 and the first excess flow conduit assembly 42 attached in fluid communication with the second conduit assembly 28. Similarly, the third fluid stream separator 80 preferably further includes a third purge gas conduit assembly 95 attached in fluid communication with the fifth valve 86 and a third excess flow conduit assembly 96 attached in fluid communication with the eleventh conduit assembly 92. Preferably, the first valve 14, when the valves are in the third configuration, periodically allows purge gas (e.g., nitrogen or purified air) to pass through the first valve 14 and on through the first sorbent chamber 18, and out the first excess flow conduit assembly 42. Also, preferably, the fifth valve 86, when the valves are in the second configuration or the third configuration, periodically allows purge gas (e.g., nitrogen or purified air) to pass through the fifth valve 86 and on through the second sorbent chamber 82, and out the third excess flow conduit assembly 96.

The first valve 14, the pre-filter 16, the fifth valve 86, the sixth valve 87 and the various conduits are preferably heated, preferably to about 190° C. or greater for situations in which diesel exhaust is the primary emission being sampled.

Figure 4:
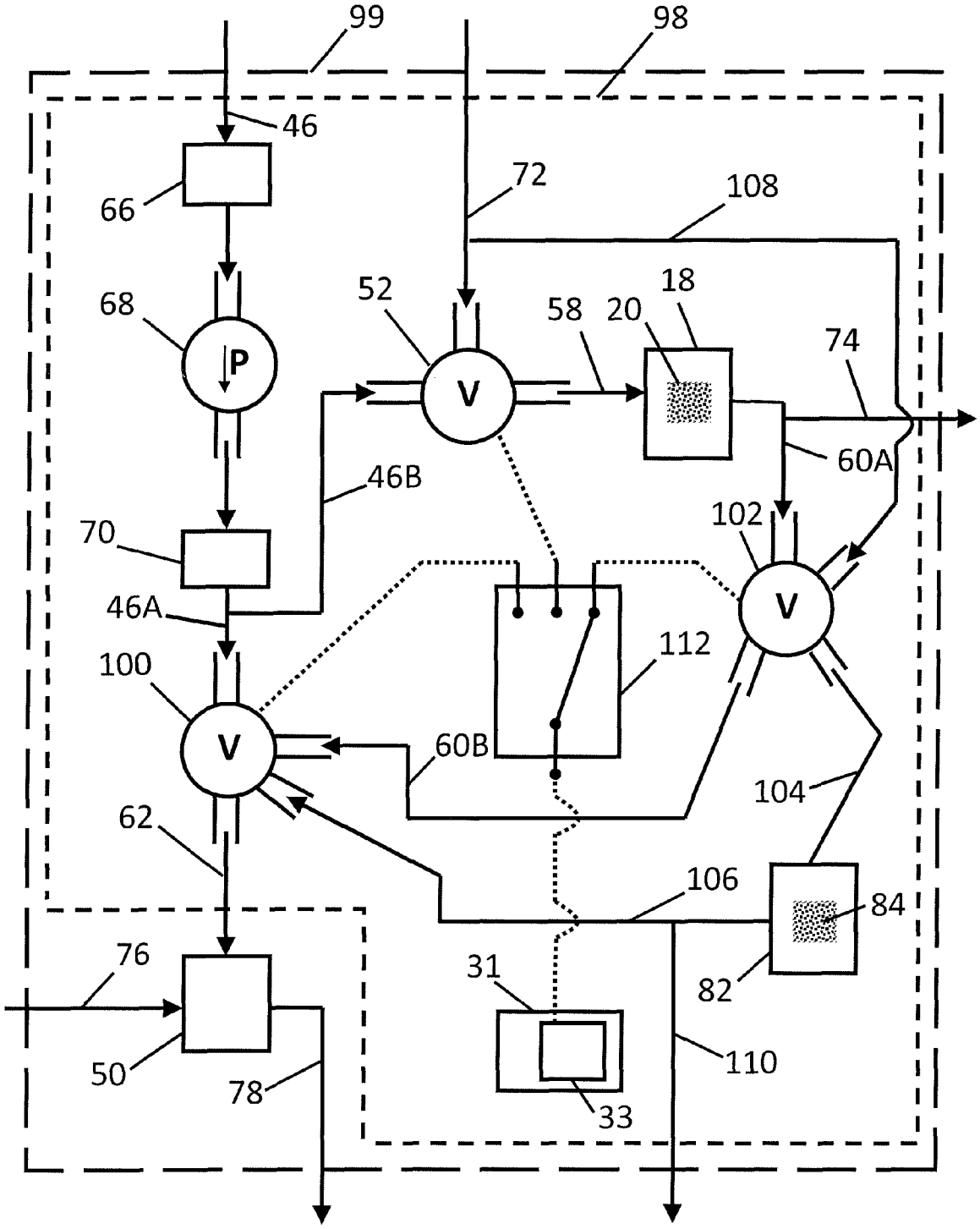
FIG. 4 is a schematic view of yet another example of a separation and a detection apparatus.

FIG. 4 shows an example of a fourth fluid stream separator 98 and a fourth fluid stream analyzer 99 that are similar to those examples shown in FIG. 2. The fourth fluid stream separator 98 in FIG. 4; however, includes the second inlet conduit assembly 46 including the second inlet first branch conduit assembly 46A and the second inlet second branch conduit assembly 46B, the fourth valve 52, a second sorbent chamber 82 including the second sorbent 84, a seventh valve 100 (similar to the fourth valve 48 of FIG. 2), and an eighth valve 102. Generally, the fourth fluid stream separator 98 includes two sorbent chambers in series, instead of two sorbent chambers in parallel as in the example shown in FIG. 2.

The seventh valve 100 is attached in fluid communication between the second inlet first branch conduit assembly 46A and the detector 50. As fluid passes through the fourth valve 52 from the second inlet second branch conduit assembly 46B and through the sorbent chamber 18, all remains substantially the same as shown in FIG. 2. When fluid exits from the sorbent chamber 18, however, variations occur with respect to the example of FIG. 2. The seventh conduit assembly 60 described with respect to FIG. 2 is sub-divided into a seventh conduit assembly first conduit 60A and a seventh conduit assembly second conduit 60B as shown in FIG. 4. The seventh conduit assembly 60 further includes the eighth valve 102. The second sorbent chamber 82 is attached in fluid communication with the eighth valve 102 via a twelfth conduit assembly 104. The seventh valve 100 is attached in serial fluid communication with the sorbent chamber 82 via a thirteenth conduit assembly 106.

The fourth fluid separator 98 is configured for attachment to the detector 50. For example the detector 50 can be a heated flame ionization detector (HFID), an infrared-type detector (IR), a mass spectrometer or other type of detector that may be disposed downstream of, attached to, or retrofitted with, the fourth fluid separator 98 to comprise the fourth fluid stream analyzer 99.

During operation, the valves shown in FIG. 4 may assume a first configuration wherein fluid is directed through the fourth valve 52, through the sorbent chamber 18, through the eighth valve 102, through the sorbent chamber 82, and through the seventh valve 100 to the detector 50.

The valves shown in FIG. 4 may also assume a second configuration wherein fluid flows through the fourth valve 52, through the sorbent chamber 18, through the eighth valve 102, and through conduit 60B and the seventh valve 100 to the detector 50, without passing through the sorbent chamber 82. The valves shown in FIG. 4 may finally assume a third configuration wherein fluid is allowed to flow directly through the seventh valve 100 directly to the detector 50 while substantially no sample fluid is allowed to flow through the sorbent chamber 18 or the sorbent chamber 82. The second purge gas conduit assembly 76 is shown in fluid communication with the second detector 50. A conduit assembly 78 directs exhaust from the second detector 50 out of the fourth fluid stream analyzer 99.

The sorbent 20 and sorbent 84 are chosen to selectively remove constituents of the sample fluid stream, such as SVOC and VOC phases of hydrocarbons for example, based on one or more physical properties such as vapor pressure. Sorbent media made of substantially inert materials may be used as the sorbent 20 and sorbent 84 to inhibit chemical reactions in the sample stream. The sorbent 20 and sorbent 84 are preferably made wholly or partially from an inert sorbent material selected from the group consisting of polymer, glass, carbon, graphite, and ceramic, for example. Media forms having a large surface area, such as beads and foam perform the best. In one example, glass beads of size (212-300 μm) (50-70 U.S. sieve) of the type available from Sigma-Aldrich Company of St. Louis, Mo. may be used. Temperature control throughout the separation apparatus 98 is vital to ensure proper separation between semi-volatile organic compounds (SVOCs), and volatile organic compounds (VOCs). Typically, the higher the temperature, the more likely various hydrocarbon species will pass through a sorbent.

The fourth fluid separator 98 preferably further includes the second purge gas conduit assembly 72 attached in fluid communication with the fourth valve 52 and the second excess flow conduit assembly 74 attached in fluid communication with the seventh conduit assembly 60. The second purge gas conduit assembly preferably includes a supplemental purge gas conduit 108 in fluid communication with the eighth valve 102. A fourth excess flow conduit assembly 110 is also provided in fluid communication with the thirteenth conduit assembly 106. Preferably, the fourth valve 52, when the valves are in the third configuration, periodically allows purge gas (e.g., nitrogen or purified air) to pass through the fourth valve 52 and on through the first sorbent chamber 18, and out the second excess flow conduit assembly 74. Preferably, the eighth valve 102, when the valves are in the second configuration or the third configuration, periodically allows purge gas to pass through the eighth valve 102 and on through the second sorbent chamber 82, and out the fourth excess flow conduit assembly 110. The various valve positions are preferably actuated by a selector switch 112 (or switches) and the associated intelligence system to be in specific positions during specific times.

Figure 5:
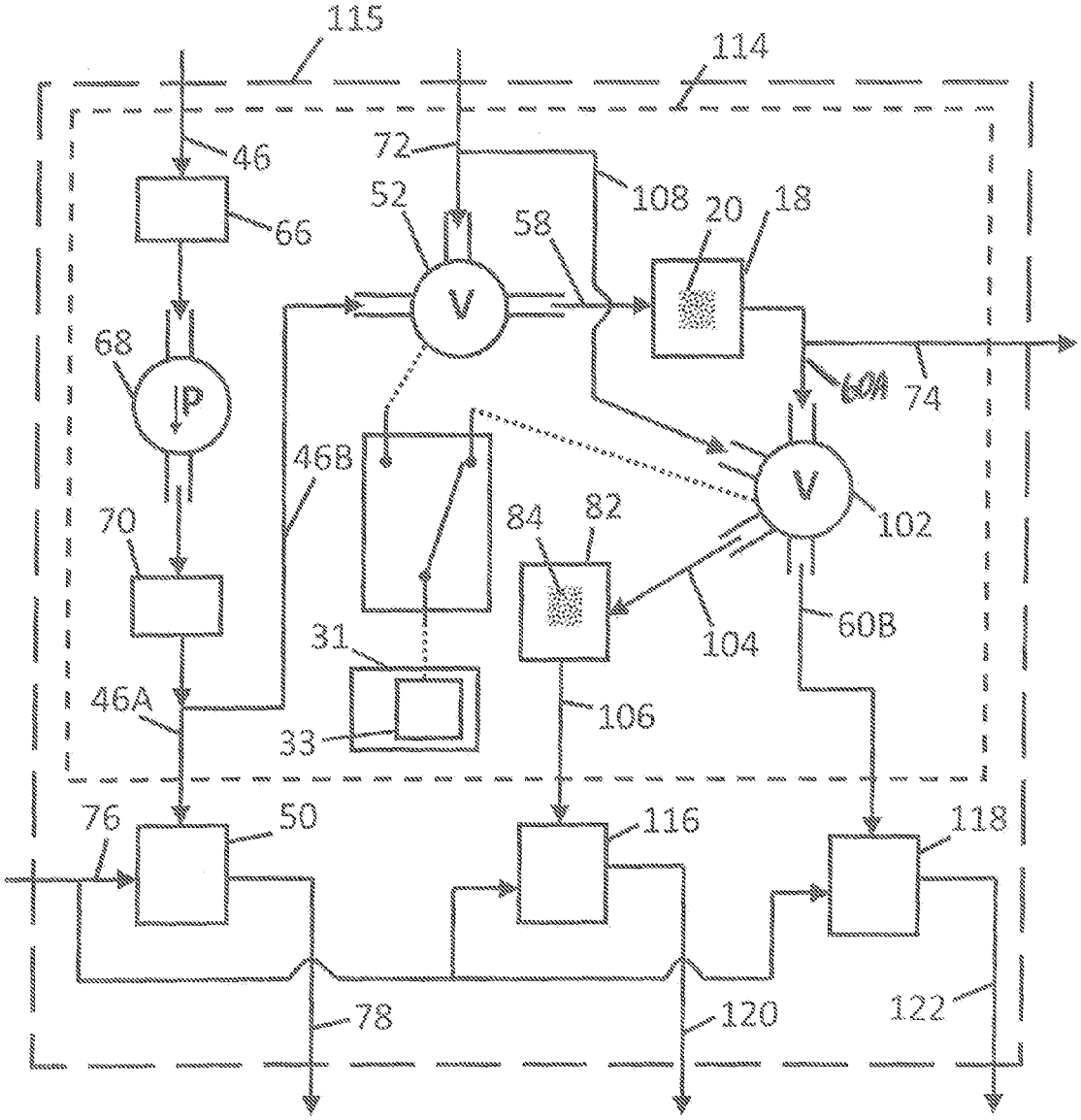
FIG. 5 is a schematic view of a final example of a separation and a detection apparatus.

FIG. 5 shows an example of a fifth fluid stream separator 114 and fifth fluid stream analyzer 115 that are similar to those of FIG. 4. Two significant differences are the absence of the seventh valve 100 and the presence of three separate detectors: detector 50, detector 116 and detector 118. Instead of directing modified fluid streams to a single detector, the seventh conduit assembly 60*a* directs fluid filtered by the sorbent chamber 18 to the detector 118, and the thirteenth conduit assembly 106 directs fluid filtered through the sorbent chamber 18 and the sorbent chamber 82 to the detector 116. The second purge gas conduit assembly 76 is shown in fluid communication with detectors 50, 116, and 118. The detector exhaust conduit assembly 78 directs exhaust from the detector 50, the detector exhaust conduit assembly 120 directs exhaust from the detector 116, and the detector exhaust conduit assembly 122 directs exhaust from the detector 118.

The example shown in FIG. 5 is particularly useful because multiple detection readings may be made substantially simultaneously in parallel, thus minimizing time for a calculation of data that is based on the detection readings.

The fifth fluid stream separator 114 is configured for attachment to detectors 50, 116 and 118 to comprise the fifth fluid stream analyzer 115. For example, the detectors 50, 116 and 118 can be heated flame ionization detectors (HFID), infrared-type detectors (IR), mass spectrometers or other detectors that may be downstream of, attached to, or retrofitted with, the fifth fluid stream separator 114.

In one exemplary implementation, a fluid stream analyzer and/or a fluid stream detector may be used with a diesel engine, to perform rapid fractionation and analysis of HCs in an exhaust stream as illustrated in any of the previous examples.

Various examples disclosed herein may be used to separate sub-portions of any fluid stream based on specific properties of each sub-portion of the fluid stream. More specifically, the examples take advantage of the differing behaviors of different classifications of hydrocarbons in a fluid stream in different physical environments (e.g., temperature or pressure). For example, the apparatus described with respect to FIG. 4 may be used to separate the different classifications of hydrocarbons in a fluid stream including SVOCs, and VOCs and determine the relative concentration of each classification. Using this data, the apparatus may be used to determine how much HC residue may be expected under specifically defined temperature conditions (i.e., the temperatures of the sorbent chamber 18 and the sorbent chamber 82, respectively).

In a typical situation in which the example shown in FIG. 2 is used in conjunction with monitoring and/or calibrating a diesel engine, a first sample stream of raw diesel exhaust is optionally drawn into a dilution device to provide non-condensing conditions and a lower sample temperature (i.e., a temperature from about 40° C. to about 50° C.). The first sample stream is drawn through the pre-filter 66 and drawn through the second inlet first branch conduit assembly 46A, the third valve 48, and the eighth conduit assembly 62, all of which are preferably heated to a temperature ranging from about 180° C. to about 200° C., and more preferably about 190° C. The first sample stream is directed to the detector 50 to be measured, characterizing the total hydrocarbon concentration in the diesel exhaust stream.

The third valve 48 and fourth valve 52 are then actuated to direct a second sample stream through the fourth valve 52, the sorbent chamber 18, the seventh conduit 60, the third valve 48, the eighth conduit assembly 62, and into the detector 50. Again, the various conduits and valves are preferably kept at a temperature ranging from about 180° C. to about 200° C., and more preferably about 190° C. The sorbent chamber 18 and the sorbent 20 are set at a temperature (e.g., about 40° C.) for the sorbent 20 to remove the SVOC fraction in the second sample stream. Sorbent media made of substantially inert materials may be used as the first sorbent 20 to inhibit chemical reactions in the sample stream. An inert sorbent material selected from the group consisting of polymer, glass, carbon, graphite, and ceramic, may be used for example. Media forms having a large surface area, such as beads and foam perform the best. In one example, glass beads of size (212-300 μm) (50-70 U.S. sieve) of the type available from Sigma-Aldrich Company of St. Louis, Mo. may be used.

The second sample stream ends up in the detector 50 to be measured, characterizing only the volatile hydrocarbons VOC in the diesel exhaust. Thus, the difference between the second sample stream and the first sample stream is the concentration of SVOC in the fluid stream. The ratio of this result to the total hydrocarbon concentration measured with respect to the first sample stream yields the fraction of SVOC to the total hydrocarbons in the exhaust stream.

The sorbent 20 may be purged with gas (e.g., nitrogen or purified air) from second purge gas conduit 72 to regenerate the sorbent media, while the sample stream is simultaneously directed to a second sorbent chamber 18*a* and sorbent 20*a* by the fourth valve 52. The temperature of the sorbent 20 may also be raised to about 200° C. during regeneration. This configuration allows one sorbent chamber to be in use while the second sorbent chamber is being purged of accumulated HCs. In this configuration, one sorbent bed is used for removal of SVOCs while the second sorbent bed is regenerated to provide continuous operation capability.

Through the steps laid out above, the two fractions of the hydrocarbons (semi-volatile and volatile) are determined from a sample fluid stream. One detector may be used in order to maximize accuracy since it will exhibit the same response characteristics when measuring from two locations, or, if higher speed is required, two detectors may be used with appropriate electronics to process the two signals to accomplish the fractionation. Variation of the sorbent media and the set temperature can be accomplished with experience to duplicate other desired conditions, such as deposit formation at higher temperatures on internal engine components. The pressure at the sorbent exit is also preferably monitored to aid in leak-checking the device.

Generally, the application of the process described above is initially anticipated to be accomplished with a unit with appropriate temperature control and valve mechanisms to support the two measurements mentioned above, and suitable for connection, directly or indirectly, to a dilution device and one or more detectors (in examples in which the detector(s) are separate from the separator). In this way, the measurements can be accomplished by retrofitting this device into existing facilities.

Additionally, identification and quantification of hydrocarbons that may play a role in atmospheric hydrocarbon formation processes is emerging as a critical issue in ambient air quality modeling. Providing an instrument capable of rapidly fractionating the hydrocarbons in engine exhaust can provide this information and thus resolve the need for data necessary to connect tailpipe exhaust emissions standards with ambient hydrocarbon observations.

The previously described examples of the present disclosure have many advantages, including the option to retrofit a preexisting instrument with a separator so that a detector associated with the measurement may be used in conjunction with the separator to rapidly determine the relative concentrations of different classifications of hydrocarbons in emission fluids. Information gleaned from various examples described herein may be used to promptly correct and/or enhance performance of an emission source and/or calibrate various aspects of an emission source.

The foregoing descriptions of various examples of the present disclosure have been presented for purposes of illustration only. The described examples are not intended to be exhaustive or to limit the scope of the disclosure to the precise form(s) disclosed. For example, the various apparatuses and methods may be applied to fluid streams found in industrial or laboratory applications. Obvious modifications or variations are possible in light of the above teachings. The examples are chosen and described in an effort to provide the best illustrations of the principles of the disclosure and its practical application, and to thereby enable one of ordinary skill in the art to utilize the concepts revealed in the disclosure in various examples and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. An apparatus for rapid fractionation of hydrocarbon phases in a sample fluid stream comprising:

a valve and conduit assembly for directing the fluid stream through a first sorbent chamber including a first sorbent, the first sorbent chamber connected in fluid communication with the valve and conduit assembly, the first sorbent selected and configured for removing a first classification of hydrocarbons from the fluid;

an intelligence system including a controller, the controller for monitoring the temperature of the first sorbent chamber and the valve and conduit assembly, and maintaining the temperature of the first sorbent chamber within a user-selectable first temperature range so that substantially all of the hydrocarbons in the form of the first classification of hydrocarbons are removed by the first sorbent and substantially all of the hydrocarbons that are not in the form of the first classification of hydrocarbons pass through the first sorbent, wherein the valve and conduit assembly is further configured for directing the fluid stream such that the fluid stream bypasses the first sorbent chamber; and wherein the apparatus further comprises a detector connected in fluid communication with the valve and conduit assembly, wherein the detector receives fluid that has not passed through the first sorbent chamber if the valve and conduit assembly is in a first configuration, and wherein the detector receives fluid that has passed through the first sorbent chamber if the valve and conduit assembly is in a second configuration, and wherein the detector is operable to produce an output signal corresponding to the hydrocarbon concentration of the fluid stream as it passes through the detector.

2. An apparatus for rapid fractionation of hydrocarbon phases in a sample fluid stream comprising:

a valve and conduit assembly for directing the fluid stream through a first sorbent chamber including a first sorbent, the first sorbent chamber connected in fluid communication with the valve and conduit assembly, the first sorbent selected and configured for removing a first classification of hydrocarbons from the fluid;

an intelligence system including a controller, the controller for monitoring the temperature of the first sorbent chamber and the valve and conduit assembly, and maintaining the temperature of the first sorbent chamber within a user-selectable first temperature range so that substantially all of the hydrocarbons in the form of the first classification of hydrocarbons are removed by the first sorbent and substantially all of the hydrocarbons that are not in the form of the first classification of hydrocarbons pass through the first sorbent, wherein the valve and conduit assembly is further configured for directing the fluid stream such that the fluid stream bypasses the first sorbent chamber; and wherein the apparatus further comprises a second sorbent chamber including a second sorbent, the second sorbent chamber connected in fluid communication with the valve and conduit assembly and configured to receive fluid that has passed through the first sorbent chamber, to receive fluid that has not passed through the first sorbent chamber, or to alternately receive fluid that has passed through the first sorbent chamber and fluid that has not passed through the sorbent chamber, the second sorbent selected and configured for removing a second classification of hydrocarbons from the fluid, and wherein the controller is further configured for monitoring the temperature of the second sorbent chamber and maintaining the temperature of the second sorbent chamber within a user-selectable second temperature range so that substantially all of the hydrocarbons in the form of the second classification of hydrocarbons are removed by the second sorbent.

3. The apparatus as recited in claim 2 wherein the second sorbent comprises an inert material.

4. The apparatus as recited in claim 3 wherein the second sorbent comprises a material selected from the group consisting of polymer, glass, carbon, graphite, and ceramic.

5. The apparatus as recited in claim 2 further comprising:

a first detector connected in fluid communication with the valve and conduit assembly for receiving fluid that has not passed through the first sorbent chamber or the second sorbent chamber, the first detector operable to produce a first output signal corresponding to the hydrocarbon concentration of the fluid that has not passed through the first sorbent chamber or the second sorbent chamber;

a second detector connected in fluid communication with the valve and conduit assembly to receive fluid that has passed through the first sorbent chamber but has not passed through the second sorbent chamber, the second detector operable to produce a second output signal corresponding to the hydrocarbon concentration of the fluid that has passed through the first sorbent chamber but not the second sorbent chamber; and a third detector connected in fluid communication with the valve and conduit assembly to receive fluid that has passed through the first sorbent chamber and the second sorbent chamber, the third detector operable to produce a third output signal corresponding to the hydrocarbon concentration of the fluid that has passed through first sorbent chamber and the second sorbent chamber.

6. The apparatus as recited in claim 5 wherein the intelligence system is configured for calculating the concentration of a first classification of hydrocarbons in response to the first output signal and the second output signal and calculating the concentration of a second classification of hydrocarbons in response to at least the second output signal and the third output signal.

7. The apparatus as recited in claim 6 wherein the first classification of hydrocarbons consists essentially of semi-volatile organic compounds (SVOCs), and the second classification of hydrocarbons consists essentially of volatile organic compounds (VOCs), and wherein the intelligence system is further configured for calculating the respective fractions of the total hydrocarbon concentration represented by semi-volatile organic compounds, and volatile organic compounds.

8. The apparatus as recited in claim 2 further comprising:

a plurality of sensors in communication with the intelligence system, the sensors for detecting temperatures in the first sorbent chamber and the second sorbent chamber so that the intelligence system may maintain the first sorbent temperature within the first temperature range and the second sorbent temperature within the second temperature range; and a cooling system for cooling the first and second sorbent chambers as needed to maintain the first sorbent temperature within the first temperature range and the second sorbent temperature within the second temperature range.

9. An apparatus for rapid fractionation of hydrocarbon phases in a sample fluid stream comprising:

a valve and conduit assembly for directing the fluid stream through a first sorbent chamber including a first sorbent, the first sorbent chamber connected in fluid communication with the valve and conduit assembly, the first sorbent selected and configured for removing a first classification of hydrocarbons from the fluid;

an intelligence system including a controller, the controller for monitoring the temperature of the first sorbent chamber and the valve and conduit assembly, and maintaining the temperature of the first sorbent chamber within a user-selectable first temperature range so that substantially all of the hydrocarbons in the form of the first classification of hydrocarbons are removed by the first sorbent and substantially all of the hydrocarbons that are not in the form of the first classification of hydrocarbons pass through the first sorbent, wherein the valve and conduit assembly is further configured for directing the fluid stream such that the fluid stream bypasses the first sorbent chamber; and wherein the apparatus further comprises a fluid dilution apparatus wherein the fluid stream is diluted by the fluid dilution apparatus prior to transport through the valve and conduit assembly.

* * * * *